US009704606B2

(12) United States Patent
Hilbert et al.

(10) Patent No.: US 9,704,606 B2
(45) Date of Patent: Jul. 11, 2017

(54) CLOSURE DEVICE FOR CONTAINERS FOR TRANSPORTING RADIOACTIVE SUBSTANCES

(71) Applicant: NUCLEAR CARGO & SERVICE GMBH, Hanau (DE)

(72) Inventors: Franz Hilbert, Wiesbaden (DE); Alois Korn, Jossgrund (DE)

(73) Assignee: DAHER NUCLEAR TECHNOLOGIES GMBH, Hanau (DE)

( * ) Notice: Subject to any disclaimer, the term of this patent is extended or adjusted under 35 U.S.C. 154(b) by 95 days.

(21) Appl. No.: 14/377,372

(22) PCT Filed: Feb. 15, 2013

(86) PCT No.: PCT/EP2013/053036

§ 371 (c)(1),
(2) Date: Aug. 7, 2014

(87) PCT Pub. No.: WO2013/120982

PCT Pub. Date: Aug. 22, 2013

(65) Prior Publication Data

US 2015/0255182 A1 Sep. 10, 2015

(30) Foreign Application Priority Data

Feb. 17, 2012 (DE) ..... 10 2012 101 300

(51) Int. Cl.
*G21F 5/12* (2006.01)
*G21F 5/06* (2006.01)
(Continued)

(52) U.S. Cl.
CPC ..... *G21F 5/12* (2013.01); *E05C 1/006* (2013.01); *G21F 5/015* (2013.01); *G21F 5/06* (2013.01); *Y10T 292/1014* (2015.04)

(58) Field of Classification Search
CPC ..... Y10T 29/49948; Y10T 29/49826; Y10T 403/7092; A61J 1/2031; A61J 1/2041;
(Continued)

(56) References Cited

U.S. PATENT DOCUMENTS 1,812,467 A * 6/1931 Blackmore ..... B62D 43/007 70/19
4,453,728 A * 6/1984 Verge ..... B62D 25/18 16/305

(Continued)

FOREIGN PATENT DOCUMENTS

CN 85109562 A 7/1986
CN 1153127 A 7/1997

(Continued)

OTHER PUBLICATIONS

Franz Hilbert et al.: "The DN30 Package for the Transport of Enriched Reprocessed Uranium—11111", in WM2011 Conference, Feb. 27-Mar. 3, 2011, Phoenix, AZ.

(Continued)

*Primary Examiner* — Suzanne Barrett
(74) *Attorney, Agent, or Firm* — Ladas & Parry LLP

(57) ABSTRACT

A closure device for containers for transporting radioactive substances, having a first and a second component each with a comb-like portion, wherein the comb-like portions, with the closure device locked, has a bolt element passing through them. The bolt element has a head with an accommodating recess running transversally to the longitudinal axis of the bolt element, that one of the components has a through-opening which, with the bolt passing through the comb-like portions, is aligned with an accommodating recess.

11 Claims, 3 Drawing Sheets

(51) Int. Cl.
*E05C 1/00* (2006.01)
*G21F 5/015* (2006.01)

(58) Field of Classification Search
CPC ..... B65D 2575/368; B65D 75/366; E05B 65/006; G21C 19/18
USPC ..... 403/311, 111, 79; 70/164, 232, 429
See application file for complete search history.

(56) References Cited

U.S. PATENT DOCUMENTS

| | | | | |
|---|---|---|---|---|
| 4,980,094 | A | 12/1990 | Critchley et al. | |
| 5,567,952 | A | 10/1996 | Kirchner et al. | |
| 5,775,139 | A * | 7/1998 | Sellers | B60D 1/60 280/507 |
| 6,044,674 | A * | 4/2000 | Rushing | E05B 73/00 411/910 |
| 6,805,253 | B1 | 10/2004 | Nicholson et al. | |
| 7,665,755 | B2 * | 2/2010 | Thomsen | B60D 1/60 280/432 |
| 2009/0113960 | A1 * | 5/2009 | Medina | F16B 19/02 70/232 |

FOREIGN PATENT DOCUMENTS

| | | | |
|---|---|---|---|
| CN | 1131528 | C | 12/2003 |
| CN | 1260739 | C | 6/2006 |
| DE | 1004996 | B | 3/1957 |
| DE | 150811 | A1 | 9/1981 |
| EP | 2335251 | B1 | 7/2014 |
| JP | 3092753 | U | 1/2003 |
| RU | 2050026 | C1 | 12/1995 |
| RU | 2084023 | C1 | 7/1997 |
| WO | 0122430 | A1 | 3/2001 |
| WO | 2010043543 | A1 | 4/2010 |

OTHER PUBLICATIONS

Kazakhstan Office Action received Aug. 18, 2014, corresponding to Kazakhstan Patent Application No. 2014/1677.1.
International Search Report dated Jun. 13, 2013, corresponding to International Patent Application PCT/EP2013/053036.
Japanese Office Action dated Dec. 20, 2016 for Japanese Application No. 2014-557048.
English translation of JP 3092753 U.

* cited by examiner

Section A-A

CLOSURE DEVICE FOR CONTAINERS FOR TRANSPORTING RADIOACTIVE SUBSTANCES

This application is a 371 of PCT/EP2013/053036, filed on Feb. 15, 2013, which claims priority to German Application No. 102012101300.4, filed Feb. 17, 2012.

The invention relates to a locking mechanism, in particular for containers for transporting radioactive substances, with a first and a second component, each with a comb-like section, whereby a bolt element passes through the comb-like sections when the locking mechanism is locked.

The invention further relates to an arrangement for the transport of in particular Uranium Hexafluoride, comprising an outer container composed of a first and a second shell, whereby the shells can be interlocked by means of at least one locking mechanism, which comprises a first and a second component, each with a comb-like section, whereby a bolt element passes through the comb-like sections when the locking mechanism is locked.

The invention particularly relates to a locking mechanism or locking system of containers for transporting radioactive substances, which 1. safeguards a secure closure of the containers in conditions to be expected during normal transport and in case of accidents,
2. facilitates handling in ambient conditions to be expected during worldwide operations, and
3. prevents or substantially impedes opening of the Locking Systems by unauthorized persons.

Uranium Hexafluoride is transported in cylindrical steel containers. These containers are specified in ISO 7195 "Packaging of Uranium Hexafluoride ($UF_6$) for Transport" or in ANSI N14.1 Uranium Hexafluoride—Packaging for Transport". During transport, the container must comply with the requirements of TS-R-1 "Regulations for the Safe Transport of Radioactive Material" of the IAEA as well as the requirements of all national and international regulations derived therefrom. During transport, steel containers for Uranium Hexafluoride with an enrichment in excess of 1% by weight of Uranium 235 in Uranium are enclosed in a special protective container that is to safeguard compliance with the above-mentioned regulations. The steel container, the special protective container, and the contents of Uranium Hexafluoride are treated by the regulations as one shipping unit.

Containers that contain Uranium Hexafluoride with an enrichment in excess of 1% by weight but not exceeding 5% by weight of Uranium 235 in Uranium must meet the following requirement—among other requirements —, which arises from standard and accident-related terms of transportation defined in TS-R-1:

The thermal test, which is described in the following under subparagraph 5. and is performed with one and the same shipping unit after the tests described by subparagraphs 1. to 4. must not result in any inadmissible pressure-buildup in the shipping unit, which could cause the shipping unit to burst.

The following tests are to be performed on one and the same shipping unit:

1. A free-fall drop test from a height that depends on the weight of the shipping unit (1.2 m for a weight of the shipping unit not to exceed 5000 kg, 0.3 m for a weight of the shipping unit in excess of 15,000 kg, with further increments between the two limiting values), onto a rigid and immovable base.

2. A penetration test performed by means of a steel rod with a weight of 3.2 kg, which impacts on the shipping unit with its point after a fall from a height of 1 m.
3. A fall from a height of 9 m onto a rigid base.
4. A fall from a height of 1 m onto a steel cylinder with a diameter of 150 mm and a minimum length of 200 mm.
5. A thermal heating test, during which the shipping unit is exposed to fire for a duration of 30 min at a temperature of 800° C.

On principle, the necessary protective function is provided by a special protective packaging, which entirely surrounds the steel cylinder that is filled with Uranium Hexafluoride. The protective packaging consists of an interior and exterior shell of for example sheet metal, which encloses a shock-absorbing layer and a thermal insulation layer of for example foam. To facilitate loading and unloading, the protective packing is subdivided into a lower and an upper half shell. The two half shells need to be locked together by a fastening mechanism, which ensures the sealing function in the above-mentioned tests according to subparagraphs 1. to 5.

The shipping units are usually transported by means of 20' ISO flat racks, which on the bottom are equipped with suitable supports. For this purpose, 4 shipping units are screwed to the supports with their longitudinal axes at right angles to the direction of travel.

As a rule, the empty special protective packaging are already bolted to flat racks when they are delivered to the suppliers who provide the cylinders filled with Uranium Hexafluoride. Here preferably only the upper half shells are taken off, so that the cylinders can be loaded into the lower half shells, whereupon the upper half shells are reattached.

In this, the lower half shells remain firmly mounted to the flat racks. As a result of the dimensioning, the distances separating the individual half-shells are limited to a few cm.

The following locking systems or mechanisms are known in the state of technology.

A classic locking mechanism consists of a bolt and a nut. This design has been used for decades for the mentioned application purpose. Attached to the outsides of each of the upper and lower shells are several mechanisms, pairs of which are tightened relative to each other by one bolt with nut. Example: Shipping unit MST-30, Certificate of approval Nr. J/159/AF-96.

The "Bolt and nut" design meets the safety-related requirements without restrictions. Handling however is difficult and time-consuming, since high levels of torque have to be applied so ensure proper locking action. In particular in conditions with limited amount of space, application of this torque can not be ensured. These locking systems are usually operated using impact screwdrivers, for example; this leads to high wear and tear and a corresponding high need for repairs. However, the locking mechanism can be opened with simple hand tools so that unauthorized persons also can obtain access to the cargo.

Yet another locking mechanism comprises a bolt with cotter pin/ball-lock-pin. This locking system has been employed for decades in packaging-related locking mechanisms. Ball-lock-pins are commonly used in the aviation industry. This mechanism consists of a central section with a bore, over which is upended a forked or tubular component with a matching bore.

The bolt/ball-lock-pin is inserted into the aligned bore of the fork/tube-shaped component and the central component and is then secured in place. Example: Shipping unit UX-30, Certificate of approval Nr. USA/9196/B(U)F-96.

The design "bolt with cotter pin" meets the safety requirements without restrictions. However, handling is quite difficult since to ensure the proper locking function, the cotter pin must be inserted into the bolt and must be locked in a suitable manner. In particular in tight space conditions, this locking cannot be guaranteed. Handling is significantly simpler for the "ball-lock-pin" design. A disadvantage is the necessary high precision of the locking mechanism components, which can not be guaranteed under the prevailing operating conditions, and the lack of robustness of the precise ball-lock-pins against normal operating conditions. Opening the locking mechanism is possible with simple hand tools (bolt with cotter pin) or even without tools at all (ball-lock pin), so that unauthorized persons could also obtain access to the cargo being transported.

A T bolt or eyebolt in combination with a rocker lever is also known in the art as a locking mechanism and for decades has been used for packaging of all types. It consists of several curved arms attached to a half shell, into each of which is inserted a T bolt or onto each of which is hooked an eyebolt, which is connected to the lower half shell via a lever mechanism and is fastened tight by actuating the lever. Example: COG-OP-30B, Certificate of approval Nr. F/358/IF-96.

The design "Bolt with rocker lever" meets the safety-related requirements, but due to the employed jointed mechanism, this locking system is susceptible to damage. This entails high maintenance requirements, since the interaction between arms, bolt, and lever must be checked and adjusted regularly. But the fundamental disadvantage originates from the space requirements for the rotation of the lever. In contrast to the other locking systems mentioned above, it is not possible to load cylinders into half-shells that are positioned close to each other on flat racks, but rather the half-shells must be dismounted from the flat rack, loaded, and re-mounted.

However, if the shipping units are mounted on a flat rack in close proximity to each, opening the locking system is not possible without difficulty, which hampers access to the cargo for unauthorized persons.

DD-A-150 811 discloses a locking mechanism with bolt and fork arms for securing the cover of a shielding container.

Known from U.S. Pat. No. 6,805,253 is a protective container consisting of two shells, whereby the shells can be locked via a cotter pin plus lever mechanism.

It is further known in the art to provide special protective containers on both sides with several independent locking closure means that are embodied according to the bolt principle. In this, a bolt passes through interlocking comb-like structures of the locking mechanism (see F. Hilbert et. al, The DN30 Overpack—A New Solution for 30B cylinders, PATRAM 2010, London).

It is the objective of the present invention to further develop a locking mechanism as well as an arrangement of the above-mentioned type in a way so that damage from mechanical impact and shear stresses is prevented and that sufficient allowances are present between the elements forming the locking mechanism, in order to allow a low-maintenance operation, without having to accept disadvantages with respect to the locking operation.

Furthermore, a single person should be able to operate the locking mechanism in a simple and economical manner. But at the same time it should be ensured that unauthorized persons cannot easily open the locking mechanism.

It should also be possible—if the locking mechanism is employed on a container that consists of two shells, i.e. in particular for the shipping units explained above—for the locking mechanism to be operated from the front side of the shipping unit.

A locking mechanism of the above-mentioned type in particular is characterized by a bolt element with a head that possesses at least one accommodating recess that extends at right angle to the longitudinal axis of the bolt element, and that at least one of the components possesses a through opening, which—if the bolt passes through the comb-like sections—is aligned with an accommodating recess, and that when the locking mechanism is locked, an element is secured in the opening, portions of which extend into the recess.

In particular it is intended that the head of the bolt possesses a planar geometry and possesses head sections with rectangular cross-sections, which extend symmetrically relative to the longitudinal axis of the bolt and project beyond the circumference of the bolt, and that each component possesses a preferably groove-like recess that can accommodate one of the head sections.

It is further intended that each head section is provided with one accommodating recess so that one accommodating recess always is aligned with the opening when the stem of the bolt passes through the comb-like structure, i.e. passes through their aligned bores.

The element that is secured in the opening preferably is a screw element that can be screwed into the opening. In this, the screw element should possess a head of unconventional shape, in order to at least make it more difficult for unauthorized persons to open it.

Each component possesses an in particular cuboid or block-like geometry, whereby the comb-like section extends from a first longitudinal side or is embodied as such.

The opening extends from the longitudinal side of the component that is situated opposite to the first longitudinal side.

The invention proposes a locking mechanism or locking system that is resistant against mechanical impact and shear stresses, since the block-like or cuboid components—also referred to as locking blocks—, may consist of heavy steel components and the bolt and its retaining mechanism are situated within the contour outline of those heavy components. The locking blocks, the interaction between the bores passing through the comb-like structure and the bolt, as well as the groove-like recesses that accommodate the head sections of the bolt may be embodied with large tolerances, without their function being negatively affected. This ensures an operation with little need for maintenance. The fastening element, i.e. the screw element performing the function of a safety bolt, only has to be tightened with low torque values since the fundamental locking function is performed by the interaction between the comb-like structure and the bolt.

On account of the invention's design, the locking mechanism can be easily operated by a single person. The safety bolt can be tightened and loosened by means of a simple hand tool. The bolt itself may be pulled out or inserted manually. As mentioned above, a bolt head of unconventional shape of the safety bolt prevents the locking mechanism from being opened by persons that have no access to the special tool.

An arrangement for the transport of preferably Uranium Hexafluoride of the above-mentioned type is characterized in that the bolt element possesses a head with at least one accommodating recess extending at right angle to the longitudinal axis of the bolt element, in that at least one of the components possesses an opening, which—when the bolt passes through the comb-like sections—is aligned with at least one accommodating recess, and in that when the locking mechanism is locked, an element is secured in the opening, portions of which also extend into the accommodating recess.

In this, it is in particular intended that at least three locking mechanisms are provided along the longitudinal sides of the outer container and along the joining line between the shells. These can be operated problem-free even if—in accordance with the state of technology—several containers are mounted on flat racks in a tightly spaced fashion.

Further details, advantages, and features of the invention are not only found in the claims, the characteristic features described therein—individually and/or in combination —, but also in the following description of a preferred embodiment example that is illustrated in the figures.

The figures show:

Figure 1:
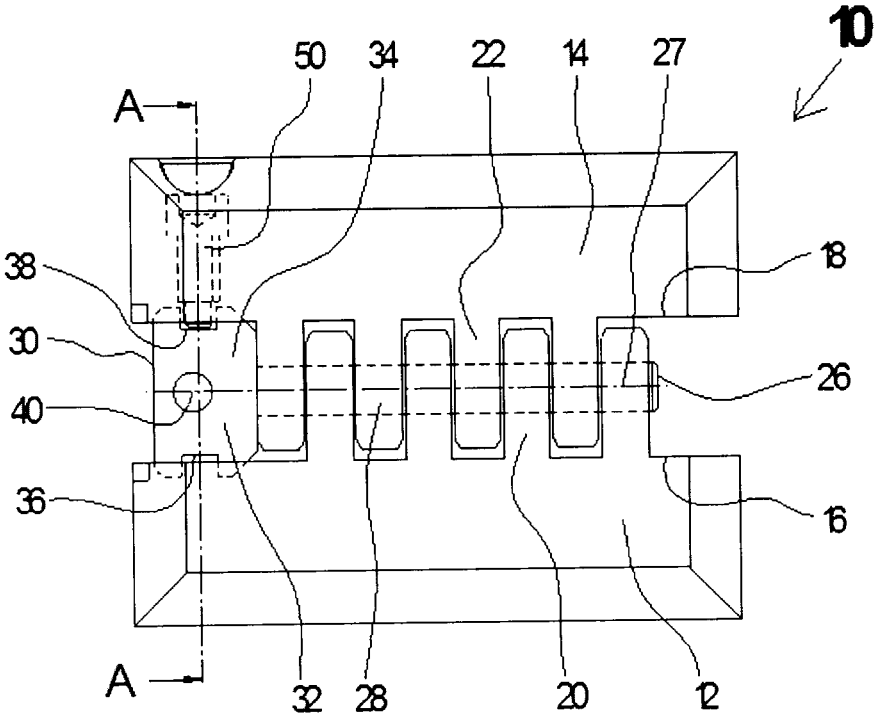
FIG. 1 shows a top view onto a locking mechanism.
Figure 2:
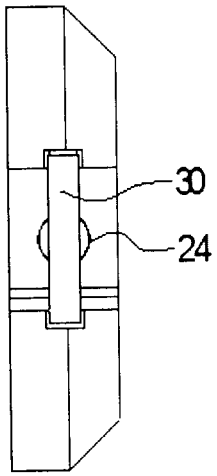
FIG. 2 shows a front view of the locking mechanism of FIG. 1.
Figure 3:
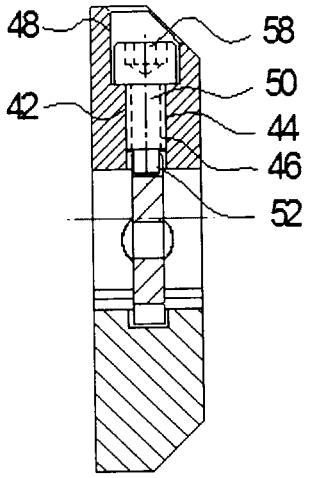
FIG. 3 shows a sectional view along the line A-A in FIG. 1.
Figure 4:
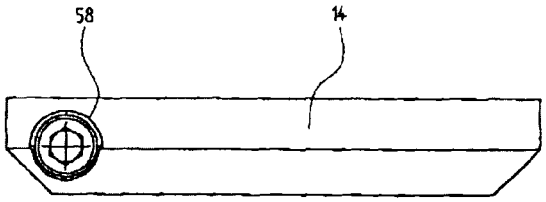
FIG. 4 shows a top view onto the locking mechanism of FIG. 1.
Figure 5:
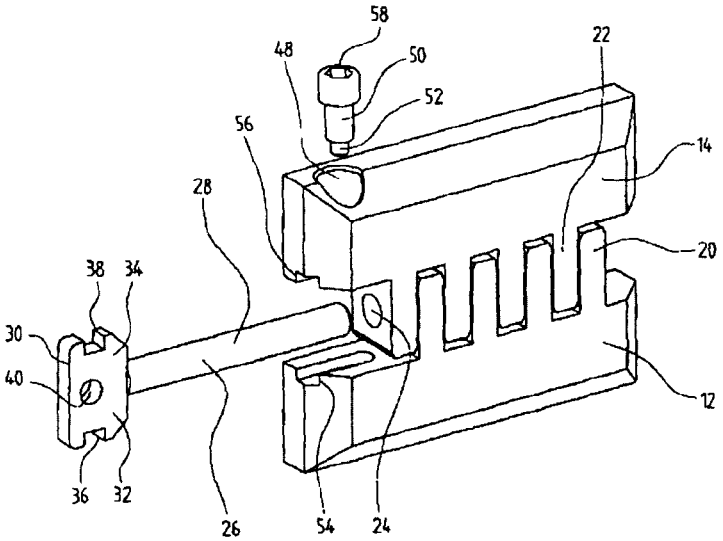
FIG. 5 shows an isometric representation of the locking mechanism of FIG. 1, partially as an exploded view.
Figure 6:
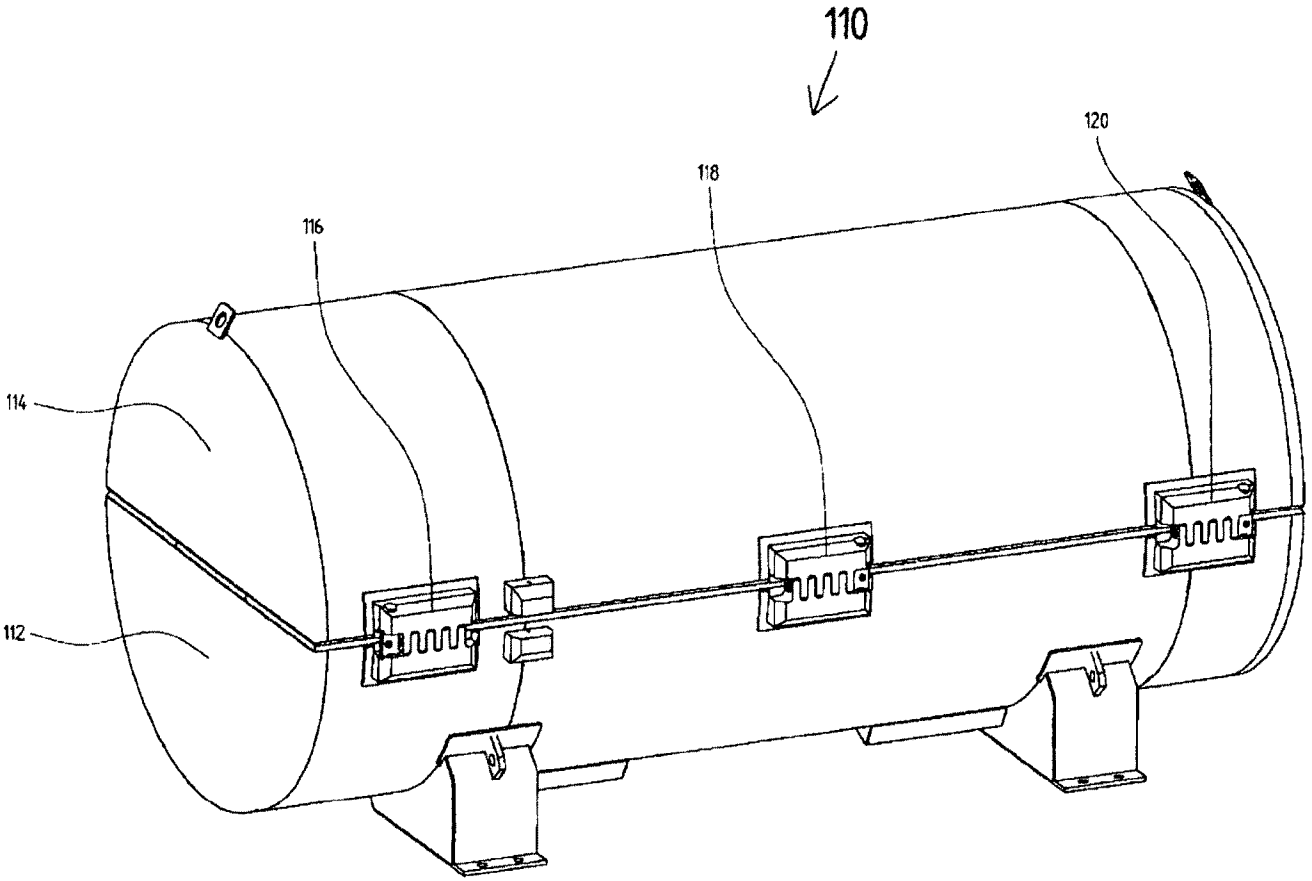
FIG. 6 shows a schematic diagram of a transport container with locking mechanisms.

FIG. 6 shows a schematic diagram of a container 110 for transporting in particular radioactive substances, such as Uranium Hexafluoride, whereby the structure may be identical to the one that is disclosed in WO-A-2010/043534. The outside container 110 consists of two shells 112, 114, that can be locked during transport via locking mechanisms 116, 118, 120. The graphic representation shows the locking mechanisms being arranged on longitudinal sides of the container 110, without this limiting in any way the scope of the invention's teaching. It is also possible for fewer or more than the three locking mechanisms 116, 118, 120 to be provided on each longitudinal side.

FIGS. 1 to 5 purely schematically illustrate the structure of the locking mechanisms 116, 118, 120, which all are of an identical design. The corresponding locking mechanism, which in FIG. 1 carries the reference label 10, consists of two block-like components 12, 14, which along one respective longitudinal side 16, 18 possess a section 20, 22 that is embodied in a comb-like manner, to create a comb-like structure. When the components 12, 14 are joined, the comb-like projections of the comb-like structures 20, 22 exhibit matching and aligned bores 24, through which passes a bolt 26 when the locking mechanism 10 is locked. The bolt 26 possesses a thread-less stem 28 and a head 30 with a rectangular longitudinal cross-section and possesses head sections 32, 34 that project beyond the circumferential surface of the stem 28, each of which possesses an accommodating recess 36, 38 that extends at a right angle to the longitudinal axis of the bolt 26. Further, the head 30 is provided with an opening 40, to allow engagement of the bolt, e.g. by the means of a tool, in particular when it is being pulled from the locking mechanism 10.

For the purpose of securing the bolt 26, in this embodiment example a trough opening 42—extending at right angles to the longitudinal axis 27 of the bolt 26—passes through the upper (in the drawing) block-like component or structural element 14—also referred to as locking block, whereby the opening consists of an inner cylindrical section 44 with inside thread 46 and an outer cylindrical section 48 with a greater diameter that is freely accessible. The opening 42 extends in parallel to the front or back side of the block-like component 14.

A safety bolt 50 can be screwed into the opening 42. The front end 52 of the safety bolt 50 engages into the groove-like recess 38 of the bolt head 30 when the locking blocks 12, 14 have been joined together, i.e. when the comb-like sections 20, 22 interlock and the stem 28 passes properly through the now freely accessible bore 24. To ensure a unique alignment of the bolt head 30, the locking blocks 12, 14, i.e. the longitudinal sides 16, 18 that possess the comb-like structures, possess groove-like recesses 54, 56, into which the head sections 32, 34 of the bolt head 30 engage in a guided manner.

The graphic representation also shows that the bolt 50 possesses a head 58 with an unconventional shape, so that loosening of the bolt is only possible with a special tool.

The locking mechanism 10 according to the invention is resistant against mechanical impact and shear stresses, since the bolt 26 extends within the contour outline of the components 12, 14 that in particular consist of heavy steel, i.e. extends within their comb-like structures 20, 22. The locking blocks 12, 14 with their comb-like sections 20, 22 and the bores 24, through which the bolt 26 passes, the bolt 26 itself as well as the groove-like accommodations 54, 56 for the bolt-head sections 32, 34 can be embodied with large tolerances without this affecting the function. This ensures an operation with low maintenance requirements. Furthermore, the safety bolt 50 has to be tightened with low torque only, since the main locking function is accomplished by the joining of the comb-like structure, i.e. the interlocking comb-like sections 20, 22 of the component 12, 14 and the bolt 26.

The safety bolt 50 can be tightened and loosened by means of a simple hand tool. The bolt 26 can be manually inserted into or pulled out of the bore 24, whereby the opening 40 serves as a guide. Since the screw head 58 is provided with a unconventional shape it can only be loosened with a special tool.

The invention claimed is:

1. A locking mechanism comprising:

a first component having a first comb-like section;

a second component having a second comb-like section;

a bolt element comprising a head portion having a plurality of faces, and a shaft portion extending from a first face of the head portion;

a recess in the head portion, said recess extending perpendicularly to a longitudinal axis of the bolt element;

wherein the shaft portion is configured to pass through the first comb-like section and second comb-like section when the locking mechanism is in a locked position;

wherein the first comb-like section and the second comb-like section form a common longitudinal plane when the locking mechanism is in the locked position;

wherein the first face of the bolt element abuts a surface of the first comb-like section when the locking mechanism is in the locked position;

wherein the first component comprises an opening that is aligned with the recess in the head portion when the shaft portion is disposed within the first comb-like section and second comb-like section;

wherein the opening runs parallel to the common longitudinal plane; and a locking element configured to be disposed in the opening;

wherein a portion of the locking element extends into the recess in the head portion when the locking mechanism is in the locked position.

2. The locking mechanism according to claim 1, wherein the head portion comprises first and second opposing sections having a rectangular cross-section; and wherein said first and second opposing sections extend symmetrically relative to a longitudinal axis of the bolt element, and project beyond a circumference of the shaft portion.

3. The locking mechanism according to claim 2, wherein the first component comprises a first groove-like recess that is configured to receive the first opposing section having a rectangular cross-section; and wherein the second component comprises a second groove-like recess that is configured to receive the second opposing section having a rectangular cross-section.

4. The locking mechanism according to claim 2, wherein the recess in the head portion is in the first opposing section or the second opposing section of the head portion.

5. The locking mechanism according to claim 1, wherein the head portion comprises a second recess in the second opposing section.

6. The locking mechanism according to claim 1, wherein the locking element is a screw locking element.

7. The locking mechanism according to claim 1, wherein the locking element comprises a head having an unconventional shape, such that a special tool is required to release the locking element.

8. The locking mechanism according to claim 1, wherein the first comb-like section extends from a first longitudinal surface of a cuboid portion of the first component; and wherein the second comb-like section extends from a second longitudinal surface of a cuboid portion of the second component.

9. The locking mechanism according to claim 8, wherein the opening extends from an outer surface of the first component to the first longitudinal surface.

10. The locking mechanism according to claim 1, wherein the first component and the second component are manufactured from steel.

11. In combination, the locking mechanism of claim 1 and a container for transporting a radioactive substance.

* * * * *